US005893243A

United States Patent [19]

Ortner

[11] Patent Number: 5,893,243

[45] Date of Patent: Apr. 13, 1999

[54] FLEXIBLE CHANNEL FOR ENCLOSURE OF GARAGE DOOR JAMS

[76] Inventor: Keith Ortner, 17 Timber La., Cedar Run, N.J. 08092

[21] Appl. No.: 08/865,011

[22] Filed: May 29, 1997

[51] Int. Cl.[6] ..... E04F 19/00

[52] U.S. Cl. ..... 52/211; 52/717.01

[58] Field of Search ..... 52/716.8, 717.01, 52/734.1, 211, 215; 49/504, 505, DIG. 1, DIG. 2

[56] References Cited

U.S. PATENT DOCUMENTS 1,277,319 8/1918 Joice ..... 52/716.8

5,488,804 2/1996 Bayscher ..... 52/717.05

*Primary Examiner*—Michael Safavi

*Attorney, Agent, or Firm*—Clifford G. Frayne

[57] ABSTRACT

Garage door frame having a trim strip attached to the horizontal and vertical jamb members in a continuous, uninterrupted manner. An elongated J-shaped channel has a long leg, a short leg parallel thereto and a cross member connecting the two legs. The shorter leg being resiliently flexible and angled towards the longer leg. The channel is snap fit over garage door jambs with the long leg extending across the reveal of the door jamb. The short leg extending across opposite parallel shoulder face of the jamb. The cross member extending along an outwardly facing surface of the garage jamb.

1 Claim, 2 Drawing Sheets

FLEXIBLE CHANNEL FOR ENCLOSURE OF GARAGE DOOR JAMS

BACKGROUND OF THE INVENTION

1. Field of the Invention

The present invention relates to channels of vinyl or aluminum siding which are utilized to cover or mask the jambs of a garage door frame.

2. Description of the Prior Art

Conventional vinyl and aluminum siding are utilized in the siding industry and with respect to certain specific tasks such as window sills and the like, special shapes or forms are utilized. However, when it is required to cover or mask the jambs of a garage door, no suitably shaped material is available which allows for the covering or masking with a continuous piece so as to provide an aesthetic cover or masking of the jambs such that it will blend in well with the existing siding. With both vinyl and aluminum siding, the installer finds himself cutting pieces to fit various corners and areas which results in a patchwork installation utilizing many fasteners which is both time consuming and aesthetically unpleasing.

Applicant has developed a channel which is suitable for use with all standard construction practices of garage doors and requires the channel only to be cut to length. Further, the design of the channel and its cooperation with the construction of garage door jambs allows for its installation in an aesthetically pleasing manner with far fewer fasteners required.

OBJECTS OF THE INVENTION

An object of the present invention is to provide for a flexible channel that is readily compatible with standard construction practices with respect to garage door jambs.

A still further object of the present invention is to provide for a novel channel which is cooperable with all standard construction practices involving the installation of garage door jambs.

A still further object of the present invention is to provide for a novel flexible channel which can be installed in a rather expeditious manner.

A still further object of the present invention is to provide for a novel flexible channel for garage door jambs which requires fewer fasteners.

A still further object of the present invention is to provide for a novel flexible channel for garage door jambs which is capable of covering the horizontal and vertical jambs in a continuous, uninterrupted fashion.

SUMMARY OF THE INVENTION

In accordance with the present invention there is provided an elongated channel for masking a garage door jamb with respect to vinyl or aluminum siding, the channel having a long leg and a short leg and a cross member connecting the two legs, the shorter leg resiliently flexible and angled towards the longer leg, the elongated channel designed to snap fit over garage door jambs in accordance with general construction principles and to be secured to the jamb in a longitudinal fashion by means of the door stop.

BRIEF DESCRIPTION OF THE DRAWINGS

These and other objects of the present invention will become evident, particularly when taken in light of the following illustrations wherein.

DETAILED DESCRIPTION OF THE DRAWINGS

Figure 1:
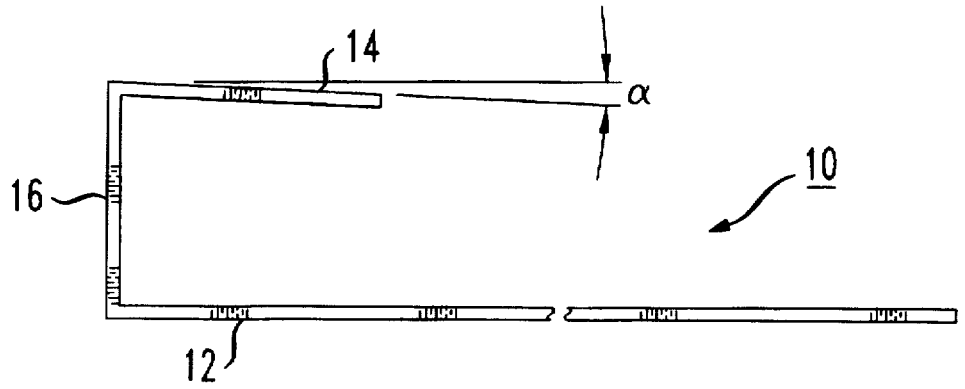
FIG. 1 is an end view of the channel.

FIG. 1 is an end view of the elongated channel 10 illustrating its J-shape in cross section. The J-channel comprises a first leg 12 and a second leg 14. First leg 12 is substantially longer than second leg 14 and it is designed to be dimensioned to mask or hide the width of the lumber utilized to frame out a garage door jamb. Typically this could be a six inch span or in some instances an 8 inch span. The first leg 12 and second leg 14 are connected by a transverse member 16 transverse member 16 being dimensioned to the depth of the lumber utilized to construct the garage door jamb. Typically, it would be dimensioned between one and a half and two inches.

Figure 2:
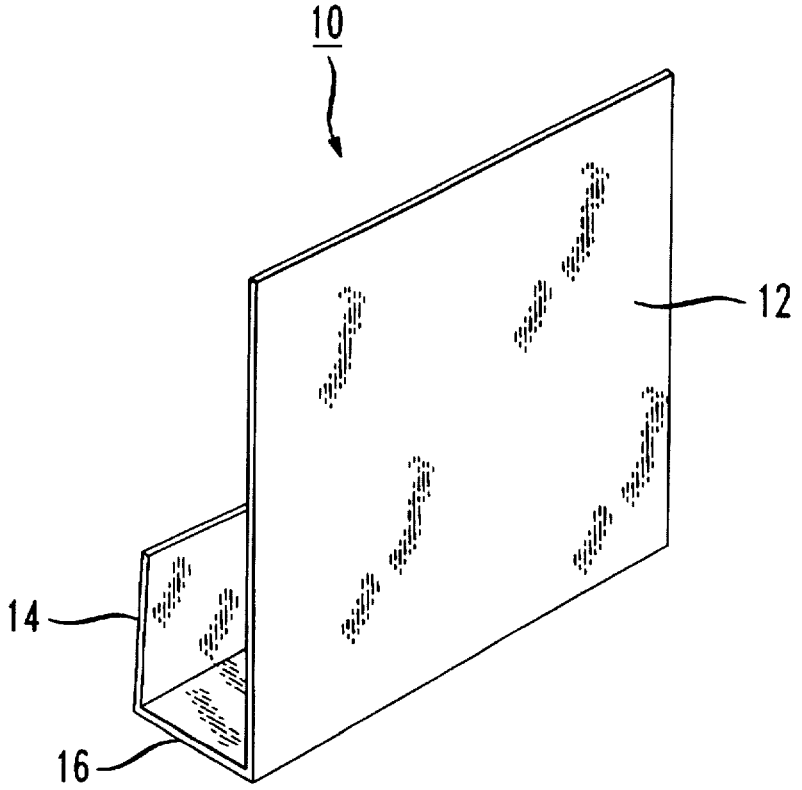
FIG. 2 is a perspective view of the channel.

The first leg 12 and second leg 14 are substantially parallel, however, second leg 14 has a slight deflection $\alpha$ from parallel alignment with first leg 12. This deflection is designed to permit the J-channel to be snap fit about a garage door jamb and to be partially maintained in position by means of the frictional engagement as a result of the deflection $\alpha$ of second leg 14. FIG. 2 is a perspective view of the J-channel illustrating the respective relationship between first leg 12 and second leg 14.

Figure 3:
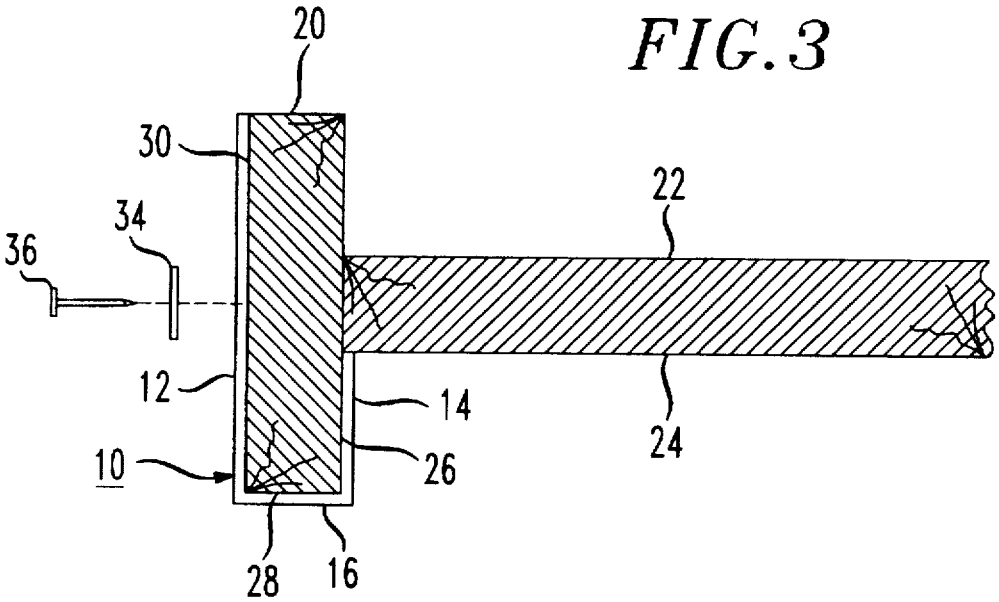
FIG. 3 is a top cutaway view of the typical construction of a vertical member of a garage door jamb illustrating the cooperation with the channel in masking or wrapping same.

FIG. 3 is a top cutaway view of a typical vertical member of a garage door jamb. In this illustration, vertical member 20 is the vertical member of one side of a garage door jamb. Typically this member 20 would be comprised of two by six or a two by eight piece of lumber. Jamb 20 would be secured to the side wall 22 of the dwelling and/or garage, with outer surface 24 of side wall 22 possibly being covered with vinyl or aluminum siding. Such covering would result in a shoulder portion 26 of vertical member 20 being exposed, as well as the front vertical face 28 (width) and the garage door facing face 30 (depth).

It can be seen that in order to cover these surfaces in an aesthetically pleasing manner, a specialized piece of siding is required. In the past, installers have had to run vertical pieces at shoulder surface 26, outwardly facing surface 28 and garage door facing surface 30 in order to aesthetically cover the jamb. This resulted in a patchwork of either vinyl or aluminum siding being applied to the jamb with a substantial number of fasteners and often times, the match up of the pieces resulted in finished product which was less than aesthetic. Applicant's J-channel 10 solves its problem in a relatively simple manner and with significantly less fasteners than required in the old method.

As previously stated, second leg 14 of J-channel 10 is slightly deflected from parallel with respect to first member 12. This permits the J-channel 10 to be snap fit over the jamb 20 such that second leg member 14 covers shoulder surface 26 of jamb 20 and firmly abuts the outer surface 24 of wall 22. Transverse member 16 of J-channel 10 is in contact with and covers the outwardly facing surface 28 of jamb 20 and first leg member 12 completely covers the garage facing surface 30 of vertical member 20.

Second leg 14 can be trimmed in length on the job site to accommodate the possibility that the outward dimension of shoulder surface 26 may vary due to construction variables. The dimension of transverse member 16 and the slight deflection of second leg member 14 will in and of itself almost insure that the J-channel 10 will be maintained in position, however, normal construction practices call for a vertical door stop 34 to be affixed to the garage door facing surface 30 of jamb 20 so as to form a seal with the edge of the garage door when it is in down position. The door stop 34 with fastener 36 can therefore by utilized to maintain J-channel 10 in position about jamb 20 with a minimum of fasteners and with a more aesthetically pleasing final product than heretofore available.

Figure 4:
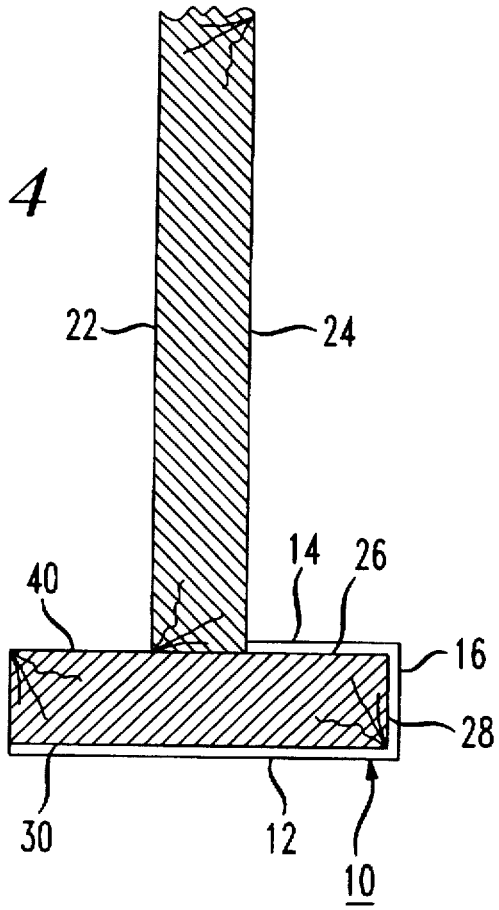
FIG. 4 is an exploded view of the horizontal member of a garage door jamb illustrating the method and manner in which the channel masks same.

FIG. 4 is a cutaway end view of the horizontal or over head member 40 of the garage door jamb. Channel 10 would be secured to horizontal member 40 in the same manner as it would be secured to vertical member 20.

While the present invention has been described with respect to the preferred embodiment thereof, we recognized by those with skill in the art that the invention may be modified without departing the sphere and scope of the claims.

I claim:

1. A preformed siding member for the aluminum and vinyl siding industry in combination with a garage door frame for masking the jambs of a garage door frame, comprising:

a garage door frame comprising horizontal upper jamb having an exposed lower surface, a partially exposed upper surface and an exposed horizontal outer edge disposed between said upper and lower surfaces, two vertical garage door jambs secured approximate the ends of said horizontal garage door jamb, said vertical garage door jambs having an exposed vertical inner surface, a partially exposed vertical outer surface and an exposed vertical edge disposed between said inner surface and said outer surface, said horizontal garage door jamb and said vertical garage door jambs being secured to an adjacent framing and adjacent walls of a building;

a preformed siding member being J-shaped in cross section having a transverse elongate web member having a first longitudinal edge and a second longitudinal edge, there being disposed on said first longitudinal edge and said second longitudinal edge, a first depending elongate leg and a second depending elongate leg respectively, projecting to one side of said transverse elongate web member, said transverse elongate web member dimensioned to the width of said exposed edge of said horizontal and vertical garage door jambs, said first elongate leg depending from said transverse elongate web member a distance dimensioned to said exposed lower surface of said horizontal jamb and said exposed inner surface of said vertical jambs, said second elongate leg member dimensioned from said transverse elongate web member a distance equal to a distance of said partially exposed upper surface of said horizontal jamb an said partially exposed outer surface of said vertical jambs, said second elongate leg forming an acute angle with said transverse elongate web member so as to permit said channel to snap fit over said garage door jamb.

* * * * *